US007325917B2

(12) United States Patent
Kohne et al.

(10) Patent No.: US 7,325,917 B2
(45) **Date of Patent: *Feb. 5, 2008**

(54) PHASE CHANGE INK TRANSFIX PRESSURE COMPONENT WITH THREE-LAYER CONFIGURATION

(75) Inventors: Jeffrey R. Kohne, Tualatin, OR (US); Santokh S. Badesha, Pittsford, NY (US); Edward B. Caruthers, Jr., Rochester, NY (US); Anthony Yeznach, Wilsonville, OR (US); Anthony S. Condello, Webster, NY (US); James P. Calamita, Spencerport, NY (US); James E. Williams, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 387 days.

This patent is subject to a terminal disclaimer.

(21) Appl. No.: 11/114,601

(22) Filed: Apr. 25, 2005

(65) Prior Publication Data

US 2006/0238585 A1 Oct. 26, 2006

(51) Int. Cl.
*B41J 2/01* (2006.01)

(52) U.S. Cl. ..... 347/103; 347/88; 347/99

(58) Field of Classification Search ..... 347/103, 347/88, 99

See application file for complete search history.

(56) References Cited

U.S. PATENT DOCUMENTS 4,889,560 A 12/1989 Jaeger et al.
5,092,235 A 3/1992 Rise
5,195,430 A 3/1993 Rise
5,389,958 A 2/1995 Bui et al.
5,502,476 A 3/1996 Neal et al.
5,919,839 A 7/1999 Titterington et al.
6,174,937 B1 1/2001 Banning et al.
6,196,675 B1 3/2001 Deily et al.
6,309,453 B1 10/2001 Banning et al.
6,648,467 B1 * 11/2003 Pan et al. ..... 347/103
2003/0224178 A1 * 12/2003 Chen et al. ..... 428/422

* cited by examiner

*Primary Examiner*—Manish S. Shah
(74) *Attorney, Agent, or Firm*—Annette L. Bade

(57) ABSTRACT

An offset printing apparatus for transferring a phase change ink onto a print medium having a phase change ink component for applying a phase change ink in a phase change ink image; an imaging member for accepting the phase change ink image from the phase change ink component, and transferring the phase change ink image from the imaging member to the print medium, and a transfix pressure member positioned in association with the imaging member, wherein the print medium passes through a nip formed between the imaging member and the transfix pressure member, and wherein the imaging member exerts pressure on the transfix pressure member so as to transfer and fuse the phase change ink image from the imaging member to the print medium, and further wherein the transfix pressure member includes a substrate; an underlayer positioned thereon; an intermediate layer positioned on the underlayer; and an outer layer positioned on the intermediate layer and the outer layer has a modulus of from about 1 to about 50 MPa, a thickness of from about 0.1 to about 2 mm, and wherein the pressure exerted at the nip is from about 750 to about 4,000 psi.

17 Claims, 1 Drawing Sheet

PHASE CHANGE INK TRANSFIX PRESSURE COMPONENT WITH THREE-LAYER CONFIGURATION

CROSS-REFERENCE TO RELATED APPLICATIONS

Attention is directed to commonly assigned U.S. patent application Ser. No. 11/114,711, filed Apr. 25, 2005, entitled, "Phase Change Ink Transfix Pressure Component with Single Layer Configuration;" and U.S. patent application Ser. No. 114,311, filed Apr. 25, 2005, entitled, "Phase Change Ink Transfix Pressure Component with Dual-Layer Configuration." The subject matter of these applications is hereby incorporated by reference in their entirety.

BACKGROUND

Herein are described phase change ink apparatuses, and more specifically, a three-layer transfix pressure member, for use in offset printing or ink jet printing apparatuses. In embodiments, the three-layer transfix pressure member can be used in high speed printing machines. In embodiments, the transfix pressure member includes a substrate, an underlayer, an intermediate layer thereon, and an outer layer positioned on the intermediate layer, wherein the layer or layers have certain moduli and thicknesses. In embodiments, the layers can be used in combination with phase change inks such as solid inks.

Ink jet printing systems using intermediate transfer, transfix or transfuse members are well known, such as that described in U.S. Pat. No. 4,538,156. Generally, the printing or imaging member is employed in combination with a printhead. A final receiving surface or print medium is brought into contact with the imaging surface after the image has been placed thereon by the nozzles of the printhead. The image is then transferred and fixed to a final receiving surface by the imaging member in combination with a transfix pressure member, or in other embodiments, by a separate fuser and pressure member.

More specifically, the phase-change ink imaging process begins by first applying a thin liquid, such as, for example, silicone oil, to an imaging member surface. The solid or hot melt ink is placed into a heated reservoir where it is maintained in a liquid state. This highly engineered ink is formulated to meet a number of constraints, including low viscosity at jetting temperatures, specific visco-elastic properties at component-to-media transfer temperatures, and high durability at room temperatures. Once within the printhead, the liquid ink flows through manifolds to be ejected from microscopic orifices through use of proprietary piezoelectric transducer (PZT) printhead technology. The duration and amplitude of the electrical pulse applied to the PZT is very accurately controlled so that a repeatable and precise pressure pulse can be applied to the ink, resulting in the proper volume, velocity and trajectory of the droplet. Several rows of jets, for example four rows, can be used, each one with a different color. The individual droplets of ink are jetted onto the liquid layer on the imaging member. The imaging member and liquid layer are held at a specified temperature such that the ink hardens to a ductile visco-elastic state.

After depositing the image, a print medium is heated by feeding it through a preheater and into a nip formed between the imaging member and a pressure member, either or both of which can also be heated. A high durometer synthetic transfix pressure member is placed against the imaging member in order to develop a high-pressure nip. As the imaging member rotates, the heated print medium is pulled through the nip and is pressed against the deposited ink image with the help of a transfix pressure member, thereby transferring the ink to the print medium. The transfix pressure member compresses the print medium and ink together, spreads the ink droplets, and fuses the ink droplets to the print medium. Heat from the preheated print medium heats the ink in the nip, making the ink sufficiently soft and tacky to adhere to the print medium. When the print medium leaves the nip, stripper fingers or other like members, peel it from the printer member and direct it into a media exit path.

To optimize image resolution, the transferred ink drops should spread out to cover a predetermined area, but not so much that image resolution is compromised or lost. The ink drops should not melt during the transfer process. To optimize printed image durability, the ink drops should be pressed into the paper with sufficient pressure to prevent their inadvertent removal by abrasion. Finally, image transfer conditions should be such that nearly all the ink drops are transferred from the imaging member to the print medium. Therefore, it is desirable that the imaging member has the ability to transfer the image to the media sufficiently.

The imaging member is multi-functional. First, the ink jet printhead prints images on the imaging member, and thus, it is an imaging member. Second, after the images are printed on the imaging member, they can then be transfixed or transfused to a final print medium. Therefore, the imaging member provides a transfix or transfuse function, in addition to an imaging function.

In order to ensure proper transfer and fusing of the ink off the imaging member to the print medium, certain nip temperature, pressure and compliance are required. Unlike laser printer imaging technology in which solid fills are produced by sheets of toner, the solid ink is placed on the imaging member one pixel at a time and the individual pixels must be spread out during the transfix process to achieve a uniform solid fill. Also, the secondary color pixels on the imaging member are physically taller than the primary color pixels because the secondary pixels are produced from two primary pixels. Therefore, compliance in the nip is required to conform around the secondary pixels and to allow the primary pixel neighbors to touch the media with enough pressure to spread and transfer. The correct amount of temperature, pressure and compliance is required to produce acceptable image quality.

Currently, the transfix pressure roller for commercial products such as, for example, Phaser 840, 850, 860, 8200 and 8400, which produce up to 24 images per minute, comprises a substrate, a polyether-based polyurethane or nitrile-butadiene rubber (NBR) intermediate layer having a hardness of from about 60 to about 74 Shore D, and having a thickness of from about 2.2 to about 5.3 mm, and an outer layer comprising a polyester-based polyurethane or nitrile butadiene rubber (NBR), having a hardness of from about 80 to about 82 Shore A, and a thickness of from about 0.24 to about 0.38 mm, and wherein the outer layer has a convex profile. A three-layer transfix pressure roller sold commercially, such as that in the Phaser 380, which produces up to 3 prints per minute, comprises a crowned profile substrate, a polyether-based polyurethane first intermediate layer having a Shore A hardness of about 40 Shore A, and a thickness of about 2.2 mm to 5.7 mm, a second intermediate layer comprises a polyether-based polyurethane having a Shore D hardness of 80 D and a thickness of 2.54 mm, and an outer layer comprising polyether-based polyurethane having a hardness of 82 Shore A and a thickness of 0.38 mm. A single layer transfix pressure roller sold, for example, as Phaser 340, 350 or 360, and produces up to 6 prints per minute, comprises a substrate, a millable gum polyether-based polyurethane material having a hardness of 35 Shore D and a thickness of 2.6 mm, wherein the layer has a convex profile.

The transfix pressure member aids in transfer and fixing from the imaging member, at a pressure of approximately 500 psi. The pressure exerted at the nip in known machines is from about 500 to about 700 psi. However, the present transfix pressure member must allow for exertion at the nip of from about 750 to about 4,000 psi, or from about 800 to about 3,000 psi, or from about 800 to about 2,000 because the present transfix pressure member is designed for use in high-pressure, high-speed machines.

Therefore, as the process speed goes up for high-speed machines, the size of the roll and the required pressure increases to enable high speed printing with desired image quality. This requires that the applied load on the transfix pressure member must be increased from 1,100 pounds to from about 2,000 to about 4,000 pounds to provide the same image quality. As the pressure requirement is increased, the design of the transfix pressure member requires that the layers on the member become thinner and harder for a given applied load on the member. As the layers become thinner and harder, the ability to keep uniform pressure across the nip, while maintaining the necessary nip profile for paper handling, becomes more and more difficult. In addition, the member sees reasonably high temperature variations, print liquids, and ink components, which could adversely affect its function and print quality. The design of the currently sold transfix pressure roller is not sufficient to meet these needs.

Therefore, it is necessary to provide a transfix pressure member design which provides desired image quality, roll life, and acceptable cost, as a compromise between the member dimensions, material properties (both physical and chemical), layer designs, surface morphology, core and layer profiles, member fabrication processes, and interlayer bonding. It is desired to optimize the transfix system performance at lower loads and with desired print quality.

SUMMARY

Embodiments include an offset printing apparatus for transferring a phase change ink onto a print medium comprising a) a phase change ink component for applying a phase change ink in a phase change ink image; b) an imaging member for accepting said phase change ink image from said phase change ink component, and transferring the phase change ink image from said imaging member to said print medium, and c) a transfix pressure member positioned in association with said imaging member, wherein said print medium passes through a nip formed between said imaging member and said transfix pressure member, and wherein said imaging member exerts pressure on said transfix pressure member so as to transfer and fuse said phase change ink image from said imaging member to said print medium, and further wherein said transfix pressure member comprises: i) a substrate; ii) an underlayer positioned thereon; iii) an intermediate layer positioned on the underlayer; and iv) an outer layer positioned on the intermediate layer, wherein the outer layer has a modulus of from about 1 to about 50 MPa, and a thickness of from about 0.1 to about 2 mm, and wherein said pressure exerted at the nip is from about 750 to about 4,000 psi.

Embodiments further include an offset printing apparatus for transferring a phase change ink onto a print medium comprising a) a phase change ink component for applying a phase change ink in a phase change ink image; b) an imaging member for accepting the phase change ink image from the phase change ink component, and transferring the phase change ink image from the imaging member to the print medium, and c) a transfix pressure member positioned in association with the imaging member, wherein the print medium passes through a nip formed between the imaging member and the transfix pressure member, and wherein the imaging member exerts pressure on the transfix pressure member so as to transfer and fuse the phase change ink image from the imaging member to the print medium, and further wherein the transfix pressure member comprises i) a substrate; ii) an underlayer thereon; iii) an intermediate layer positioned on the underlayer; and iv) a polyurethane outer layer positioned on the intermediate layer, wherein the outer layer has a modulus of from about 1 to about 50 MPa, and a thickness of from about 0.1 to about 2 mm, and wherein the pressure exerted at the nip is from about 750 to about 4,000 psi.

Embodiments also include an offset printing apparatus for transferring a phase change ink onto a print medium comprising a) a phase change ink component for applying a phase change ink in a phase change ink image; b) an imaging member for accepting the phase change ink image from the phase change ink component, and transferring the phase change ink image from the imaging member to the print medium, and c) a transfix pressure member positioned in association with the imaging member, wherein the print medium passes through a nip formed between the imaging member and the transfix pressure member, and wherein the imaging member exerts pressure on the transfix pressure member so as to transfer and fuse the phase change ink image from the imaging member to the print medium, and further wherein the transfix pressure member comprises i) a substrate; ii) an underlayer positioned thereon; iii) an intermediate layer positioned on the substrate; and iv) an outer layer positioned on the intermediate layer, wherein the outer layer has a convex crown and comprises a polyurethane having a modulus of from about 1 to about 50 MPa, and a thickness of from about 0.1 to about 2 mm, and wherein the pressure exerted at the nip is from about 750 to about 4,000 psi.

DETAILED DESCRIPTION

Herein is described an offset printing apparatus useful with phase-change inks such as solid inks, and comprising a coated transfix pressure member, which aids in the transfer and fixing of a developed ink image to a copy substrate. In embodiments, the transfix pressure member is useful in high speed, high pressure printing applications. In embodiments, the transfix pressure member comprises a substrate, an underlayer thereon, an intermediate layer on the underlayer, and an outer layer on the intermediate layer. The details of embodiments of phase-change ink printing processes are described in the patents referred to above, such as U.S. Pat.

Nos. 5,502,476; 5,389,958; and 6,196,675 B1, the disclosures of each of which are hereby incorporated by reference in their entirety.

Figure 1:
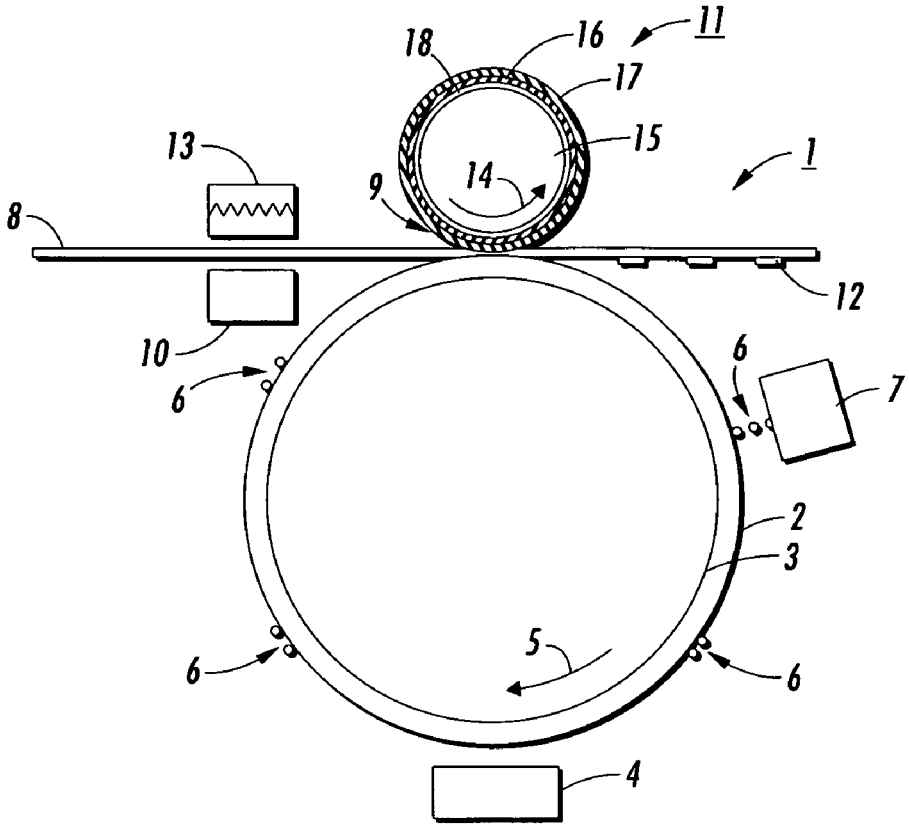
FIG. 1 is an illustration of an embodiment, and includes a transfer printing apparatus using an imaging member in the form of a drum.

Referring to FIG. 1, offset printing apparatus 1 is demonstrated to show transfer of an ink image from the imaging member to a final printing medium or receiving substrate. As the imaging member 3 turns in the direction of arrow 5, a liquid surface 2 is deposited on imaging member 3. The imaging member 3 is depicted in this embodiment as a drum member. However, it should be understood that other embodiments can be used, such as a belt member, film member, sheet member, or the like. The liquid layer 2 is deposited by an applicator 4 that may be positioned at any place, as long as the applicator 4 has the ability to make contact and apply liquid surface 2 to imaging member 3.

The ink used in the printing process can be a phase change ink, such as, for example, a solid ink. The term "phase change ink" means that the ink can change phases, such as a solid ink becoming liquid ink or changing from solid into a more malleable state. Specifically, in embodiments, the ink can be in solid form initially, and then can be changed to a molten state by the application of heat energy. The solid ink may be solid at room temperature, or at about 25° C. The solid ink may possess the ability to melt at relatively high temperatures above from about 65° C. to about 150° C. The ink is melted at a high temperature and then the melted ink 6 is ejected from printhead 7 onto the liquid layer 2 of imaging member 3. The ink is then cooled to an intermediate temperature of from about 20° C. to about 80° C., or about 65° C., and solidifies into a malleable state in which it can then be transferred onto a final receiving substrate 8 or print medium 8.

The ink has a viscosity of from about 5 to about 30 centipoise, or from about 8 to about 20 centipoise, or from about 10 to about 15 centipoise at about 140° C. The surface tension of suitable inks is from about 23 to about 50 dynes/cm. Examples of a suitable inks for use herein include those described in U.S. Pat. Nos. 4,889,560; 5,919,839; 6,174,937; and 6,309,453, the disclosure each of which are hereby incorporated by reference in their entirety.

Some of the liquid layer 2 is transferred to the print medium 8 along with the ink. A typical thickness of transferred liquid is about 100 angstroms to about 100 nanometer, or from about 0.1 to about 200 milligrams, or from about 0.5 to about 50 milligrams, or from about 0.5 to about 10 milligrams per print medium.

Suitable liquids that may be used as the print liquid surface 2 include water, fluorinated oils, glycol, surfactants, mineral oil, silicone oil, functional oils, and the like, and mixtures thereof. Functional liquids include silicone oils or polydimethylsiloxane oils having mercapto, fluoro, hydride, hydroxy, and the like functionality.

Feed guide(s) 10 and 13 help to feed the print medium 8, such as paper, transparency or the like, into the nip 9 formed between the pressure member 11 (shown as a roller), and imaging member 3. It should be understood that the pressure member can be in the form of a belt, film, sheet, or other form. In embodiments, the print medium 8 is heated prior to entering the nip 9 by heated feed guide 13. When the print medium 8 is passed between the imaging member 3 and the transfix pressure member 11, the melted ink 6 now in a malleable state is transferred from the imaging member 3 onto the print medium 8 in image configuration. The final ink image 12 is spread, flattened, adhered, and fused or fixed to the final print medium 8 as the print medium moves between nip 9. The nip width is from about 2.0 to about 6.0, or from about 3.0 to about 5.5 mm. Alternatively, there may be an additional or alternative heater or heaters (not shown) positioned in association with offset printing apparatus 1. In another embodiment, there may be a separate optional fusing station located downstream of the feed guides.

The pressure exerted at the nip 9 in known machines is from about 500 to about 700 psi. However, the present transfix pressure member must allow for exertion at the nip 9 of from about 750 to about 4,000, or from about 800 to about 3,000 psi, or from about 800 to about 2,000.

Stripper fingers (not shown) may be used to assist in removing the print medium 8 having the ink image 12 formed thereon to a final receiving tray (also not shown).

Figure 2:
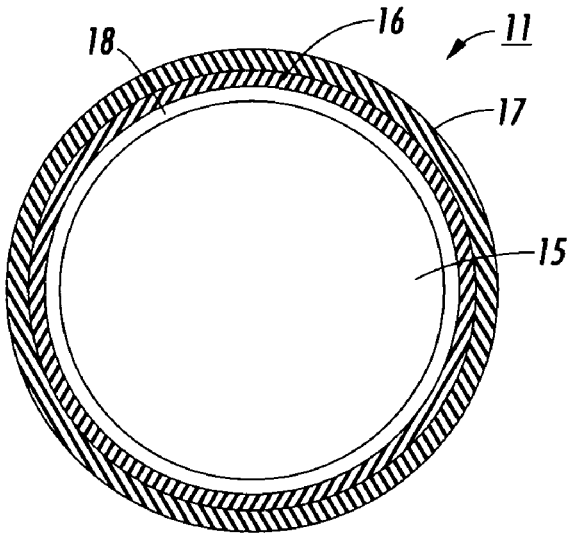
FIG. 2 is an enlarged view of an embodiment of a transfix pressure member having a substrate, intermediate layer, and an outer layer thereon.

FIG. 2 is an enlarged view of the transfix pressure member and demonstrates substrate 15, and outer layer 17 positioned on the substrate 15. In embodiments, an outer liquid layer (not shown) is present on the outer layer 17. In embodiments, an intermediate layer 16 may be positioned between the substrate 15 and outer layer 17. In embodiments, an underlayer 18 may be positioned on the substrate, an intermediate layer positioned on the underlayer and an outer layer 17 positioned on the intermediate layer.

In embodiments, the outer layer comprises a urethane material, such as a polyurethane material. Examples of suitable polyurethanes include polyester-based polyurethanes.

In embodiments, the transfix pressure member has a one-layer configuration, which includes a substrate and an outer layer. In this one-layer configuration, the modulus of the outer layer is from about 8 to about 300 MPa, or from about 25 to about 250 MPa, or from about 50 to about 200 MPa. The thickness of the outer layer in the one-layer configuration is from about 0.3 to about 10 mm, or from about 1 to about 8 mm, or from about 2 to about 6 mm.

In embodiments, the transfix pressure member comprises a two-layer configuration comprising a substrate, intermediate layer and outer layer. In this application, the substrate is not referred to as a layer. The modulus of the intermediate layer in the two-layer configuration is from about 50 to about 300 MPa, or from about 70 to about 250 MPa, or from about 100 to about 200 MPa. In embodiments, the thickness of the intermediate layer is from about 0.5 to about 10 mm, or from about 1 to about 5 mm, or from about 1.5 to about 4 mm. The modulus of the outer layer in the two-layer configuration is from about 1 to about 50 MPa, or from about 5 to about 45 MPa, or from about 10 to about 40 MPa. In embodiments, the thickness of the outer layer in the two-layer configuration is from about 0.1 to about 2 mm, or from about 0.2 to about 1.5 mm, or from about 0.3 to about 1 mm.

In embodiments, the transfix pressure member comprises a three-layer configuration, which includes a substrate, an underlayer on the substrate, an intermediate layer positioned on the underlayer, and an outer layer positioned on the intermediate layer. In embodiments, the modulus of the underlayer is from about 1 to about 100 MPa, or from about 5 to about 70 MPa, or from about 10 to about 50 MPa. In embodiments, the thickness of the underlayer is from about 0.5 to about 6 mm, or from about 1 to about 4 mm, or from about 1.5 to about 3 mm. In embodiments, the modulus of the intermediate layer in the three-layer configuration is from about 100 to about 500 MPa, or from about 150 to about 450 MPa, or from about 200 to about 400 MPa. In embodiments, the thickness of the intermediate layer in the three-layer configuration is from about 2 to about 10 mm, or from about 2.5 to about 6 mm, or from about 3 to about 6 mm. In embodiments, the modulus of the outer layer is from about 1 to about 50 MPa, or from about 5 to about 45 MPa, or from about 10 to about 40 MPa. In embodiments, the thickness of the outer layer is from about 0.1 to about 2 mm, or from about 0.2 to about 1.5, or from about 0.3 to about 1 mm.

In embodiments, the underlayer, intermediate layer, and/or the outer layer may comprise a urethane or a polyurethane material. Examples of suitable polyurethanes include polyester-based polyurethanes.

One or more of the layers of the three different configurations of transfix pressure member may have a convex crown, such that the pressure of the ends of the roll is from about 5 to about 50 percent higher than the pressure in the center of the roller.

The substrate, intermediate layer(s), and/or outer layer, in embodiments, may comprise fillers dispersed therein. These fillers can have the ability to increase the material hardness or modulus into the desired range.

Examples of fillers include fillers such as metals, metal oxides, doped metal oxides, carbon blacks, ceramics, silicates (such as zirconium silicate, mica and the like), polymers, and the like, and mixtures thereof. Examples of suitable metal oxide fillers include titanium dioxide, tin (II) oxide, aluminum oxide, indium-tin oxide, magnesium oxide, copper oxide, iron oxide, silica or silicon oxide, and the like, and mixtures thereof. Examples of carbon fillers include carbon black (such as N-990 thermal black, N330 and N110 carbon blacks, and the like), graphite, fluorinated carbon (such as ACCUFLUOR® or CARBOFLUOR®), and the like, and mixtures thereof. Examples of ceramic materials include aluminum nitride, boron nitride, silicates such as zirconium silicates, and the like, and mixtures thereof. Examples of polymer fillers include polytetrafluoroethylene powder, polypyrrole, polyacrylonitrile (for example, pyrolyzed polyacrylonitrile), polyaniline, polythiophenes, and the like, and mixtures thereof. The optional filler is present in the substrate, optional underlayer, optional intermediate layer, and/or outer layer in an amount of from about 0 to about 60 percent, or from about 1 to about 20 percent, or from about 1 to about 5 percent by weight of total solids in the layer.

The transfix pressure substrate can comprise any material having suitable strength for use as an imaging member substrate. Examples of suitable materials for the substrate include metals, fiberglass composites, rubbers, and fabrics. Examples of metals include steel such as stainless steel, carbon steel and the like, aluminum such as anodized aluminum and the like, nickel, and their alloys, and like metals, and alloys of like metals. The thickness of the substrate can be set appropriate to the type of imaging member employed.

Examples of suitable imaging substrates include a sheet, a film, a web, a foil, a strip, a coil, a cylinder, a drum, an endless strip, a circular disc, a belt including an endless belt, an endless seamed flexible belt, an endless seamless flexible belt, an endless belt having a puzzle cut seam, a weldable seam, and the like.

In embodiments, the transfix pressure member is a roller. The length of the roller may be from about 200 to about 700 mm, or from about 300 to about 500 mm, or from about 380 to about 457 mm.

In embodiments, the intermediate layer(s) does not delaminate from the core by transfer of at least 1,000,000 copy substrates under normal use conditions. In embodiments, the outer layer does not delaminate from the inner layer and the inner layer does not delaminate from the substrate, by transfer of at least 1,000,000 copy substrates under normal use conditions.

Specific embodiments of the invention will now be described in detail. These examples are intended to be illustrative, and the invention is not limited to the materials, conditions, or process parameters set forth in these embodiments. All parts are percentages by weight of total solids as defined above unless otherwise indicated.

EXAMPLES

Example 1

Preparation of a Transfix Pressure Member Having One Layer

A carbon steel core having an inner diameter of 44.5 mm, an outer diameter of 63.2 mm, and a length of 445 mm from Northwest Machine Works of Canby Oregon was degreased and cleaned by known methods. A primer layer was coated onto this core. A polyester based polyurethane composition was prepared by reacting an isocyanate end-capped prepolymer with a functional crosslinking agent in the presence of an appropriate catalyst. Test specimens were prepared for mechanical property testing according to standard test protocol. The elastic modulus at ambient was found to be 64.4 MPa, which did not change more than 35 percent when tested up to 72° C. and did not change more than 25 percent when tested at 50° C. The layer was cast in an open mold. The layer was then machined to uniform thickness by grinding. The thickness of the layer was approximately 3.0 mm. The outer profile was ground cylindrical to a diameter of 69 mm.

This roll was installed in a printing test fixture, which applied about a 1,700 to about 2,300 pound load resulting in about a pressure at the nip of from about 950 to about 1,000 psi. The roll was print tested. The results demonstrated acceptable print quality performance as measured by standard metrics and in comparison to previous solid ink products. A similar roller was tested for debonding in an accelerated test fixture, which showed a life of greater than 750,000 prints equivalent.

Example 2

Preparation of a Transfix Pressure Member Having Two Layers

A carbon steel core having an inner diameter of 44.5 mm an outer diameter of 66.2 mm, and length of 445 mm from Northwest Machine Works of Canby Oregon was degreased and cleaned by known methods. A primer layer of 0.002 inches was spray coated onto this core. A polyester based polyurethane composition was prepared by reacting an isocyanate end-capped prepolymer with a functional crosslinking agent in the presence of an appropriate catalyst. Test specimens were prepared for mechanical property testing according to standard test protocol. The elastic modulus at ambient was found to be 199 MPa, which did not change more than 36.7 percent when tested up to 72° C. and did not change more than 23.1 percent when tested at 50° C. The intermediate layer was cast by a flow coating method. The layer was then machined to uniform thickness by grinding. The thickness of the layer was 1.5 mm.

The machined layer was then primed and an outer layer was flow coated with a polyester based polyurethane prepared by a similar reaction of an isocyanate end-capped prepolymer with a functional crosslinking agent in the presence of an appropriate catalyst. The thickness of the outer layer was determined to be about 0.4 mm. The mechanical property testing of the sample buttons standard ASTM test protocol from this material indicated the elastic modulus to be 17 MPa at ambient temperature. The material showed approximately uniform modulus across temperature to 75° C.

The outer layer was then profile ground to achieve a convex radius of 200 meters.

This roll was installed in a printing test fixture, which applied about a 1,500 to about 2,000 pound load resulting in about a pressure at the nip of from about 800 to about 1,200 psi. The roll was print tested. The results demonstrated acceptable print quality performance as measured by standard metrics and in comparison to previous solid ink products. A similar roller was tested for debonding in an accelerated test fixture, which showed a life of greater than 750,000 prints equivalent.

Example 3

Preparation of a Transfix Pressure Member Having Three Layers

A carbon steel core having an inner diameter of 19.86 mm an outer diameter of 43.688 mm, and length of 403.45 mm was degreased and cleaned by known methods. The outer diameter was ground to a convex crown with a circular radius of 5.9 meters. A primer layer of 0.002 inches was spray coated onto this core. A polyester based polyurethane composition was prepared by reacting an isocyanate end-capped prepolymer with a functional crosslinking agent in the presence of an appropriate catalyst. Test specimens were prepared for mechanical property testing according to the standard ASTM test protocol. The elastic modulus at ambient temperature was found to be 64 MPa, which decreased by about 25 percent when tested at 50° C. The first intermediate layer was cast in an open mold. The layer was then machined to a uniform diameter by grinding. The thickness of the layer was 2.225 mm.

The machined layer was then primed and a second intermediate layer was coated from a polyester based polyurethane prepared by a similar reaction of an isocyanate end-capped prepolymer with a functional crosslinking agent in the presence of an appropriate catalyst. This layer was machined to uniform diameter by grinding. The thickness of the second intermediate layer was determined to be 2.54 mm. The mechanical property testing of the test specimens by standard ASTM test protocol from this material indicated the elastic modulus to be 451 MPa at ambient temperature. The material showed a drop in elastic modulus of approximately 10 percent when tested at 50° C. and a drop of approximately 18% when tested at 72° C.

This machined layer was then primed and a third outermost layer was applied from polyester based polyurethane by open mold casting. The mechanical property testing of the sample buttons by standard ASTM test protocol from this material indicated the elastic modulus to be 19.8 MPa at ambient temperature. The material showed a drop in elastic modulus of approximately 6 percent when tested at 50° C. and a drop of approximately 9 percent when tested at 72° C. The outermost layer was then machined to a uniform diameter by grinding. The layer thickness was 0.381 mm.

This roll was used in print tests at a transfix speed of 57 inches/second and transfix pressures of from about 750 to about 1,500 psi. A variety of image quality properties were evaluated, including solids, halftones, text and lines. Image quality was judged acceptable. The transfix roll life is estimated to be acceptable.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

What is claimed is:

1. An offset printing apparatus for transferring a phase change ink onto a print medium comprising:

a) a phase change ink component for applying a phase change ink in a phase change ink image;

b) an imaging member for accepting the phase change ink image from the phase change ink component, and transferring the phase change ink image from the imaging member to the print medium, and c) a transfix pressure member positioned in association with the imaging member, wherein the print medium passes through a nip formed between the imaging member and the transfix pressure member, and wherein the imaging member exerts pressure on the transfix pressure member so as to transfer and fuse the phase change ink image from the imaging member to the print medium, and further wherein the transfix pressure member comprises:

i) a substrate;

ii) an underlayer positioned thereon;

iii) an intermediate layer positioned on the underlayer; and iv) an outer layer positioned on the intermediate layer, wherein said outer layer comprises a urethane material and has a modulus of from about 1 to about 50 MPa, and a thickness of from about 0.1 to about 2 mm, and wherein the pressure exerted at the nip is from about 750 to about 4,000 psi.

2. The offset printing apparatus of claim 1, wherein the outer layer has a modulus of from about 5 to about 45 MPa.

3. The offset printing apparatus of claim 1, wherein the outer layer has a thickness of from about 0.2 to about 1.5 mm.

4. The offset printing apparatus of claim 1, wherein said intermediate layer has a modulus of from about 100 to about 300 MPa.

5. The offset printing apparatus of claim 1, wherein said intermediate layer has a thickness of from about 2 to about 10 mm.

6. The offset printing apparatus of claim 1, wherein the underlayer has a modulus of from about 1 to about 100 MPa.

7. The offset printing apparatus of claim 1, wherein the underlayer has a thickness is from about 0.5 to about 6 mm.

8. The offset printing apparatus of claim 1, wherein the pressure exerted at the nip is from about 800 to about 3,000 psi.

9. The offset printing apparatus of claim 8, wherein the pressure is from about 800 to about 2,000 psi.

10. The offset printing apparatus of claim 1, wherein the outer layer comprises a filler.

11. The offset printing apparatus of claim 10, wherein the filler is selected from the group consisting of metals, metal oxides, carbon blacks, ceramics, silicates, polymers, and mixtures thereof.

12. The offset printing apparatus of claim 1, wherein the outer layer comprises a convex crown.

13. The offset printing apparatus of claim 12, wherein a pressure on an end of the transfix pressure member is from about 5 to about 50 percent higher than a pressure in the center of the transfix pressure member.

14. The offset printing apparatus of claim 1, wherein the phase change ink is solid at about 25° C.

15. The offset printing apparatus of claim 1, wherein the phase change ink comprises a dye.

16. The offset printing apparatus of claim 1, wherein the urethane is a polyurethane.

17. An offset printing apparatus for transferring a phase change ink onto a print medium comprising:

a) a phase change ink component for applying a phase change ink in a phase change ink image;

b) an imaging member for accepting the phase change ink image from the phase change ink component, and transferring the phase change ink image from the imaging member to the print medium, and c) a transfix pressure member positioned in association with the imaging member, wherein the print medium passes through a nip formed between the imaging member and the transfix pressure member, and wherein the imaging member exerts pressure on the transfix pressure member so as to transfer and fuse the phase change ink image from the imaging member to the print medium, wherein the pressure exerted at the nip is from about 750 to about 4,000 psi, and further wherein the transfix pressure member comprises:

i) a substrate;

ii) an underlayer positioned thereon;

iii) an intermediate layer positioned on said underlayer; and iv) an outer layer positioned on said intermediate layer, wherein said outer layer has a convex crown and comprises a polyurethane having a modulus of from about 1 to about 50 MPa, and a thickness of from about 0.1 to about 2 mm, and wherein the pressure exerted at the nip is from about 750 to about 4,000 psi.

* * * * *